US005626781A

United States Patent [19]

Schmidt et al.

[11] Patent Number: 5,626,781

[45] Date of Patent: May 6, 1997

[54] GLOW PLUG WITH PROTECTIVE COATING

[75] Inventors: Gabriele Schmidt; Karl-Heinz Schmidt, both of Ludwigsburg; Hans Delesky, Sachsenheim, all of Germany

[73] Assignee: Beru Ruprecht GmbH & Co., Germany

[21] Appl. No.: 623,217

[22] Filed: Mar. 28, 1996

[30] Foreign Application Priority Data

Mar. 28, 1995 [DE] Germany ..... 195 11 376.4

[51] Int. Cl.[6] ..... F23Q 7/00

[52] U.S. Cl. ..... 219/270; 123/145 A; 361/266

[58] Field of Search ..... 219/270, 267, 219/264, 260, 544; 123/145 A; 361/264–266; 338/22 R, 225 D

[56] References Cited

U.S. PATENT DOCUMENTS 4,746,896 5/1988 Mcquaid et al. ..... 338/22 R

FOREIGN PATENT DOCUMENTS

| | | | |
|---|---|---|---|
| 57-155025 | 9/1982 | Japan | 219/270 |
| 58-123025 | 7/1983 | Japan | 219/270 |
| 58-150715 | 9/1983 | Japan | 219/270 |
| 59-167735 | 9/1984 | Japan | 219/270 |
| 4-263702 | 9/1992 | Japan | 219/270 |
| 4-288410 | 10/1992 | Japan | 219/270 |
| 86805 | 1/1956 | Norway | 123/145 A |
| 927336 | 5/1963 | United Kingdom | 123/145 A |

*Primary Examiner*—John A. Jeffery
*Attorney, Agent, or Firm*—Sixbey, Friedman, Leedom & Ferguson, P.C.; David S. Safran

[57] ABSTRACT

Glow plug with a heating rod formed of an inner pole (2) and a glow tube (5), in which a heating element (3) is located which is electrically connected to the inner pole (2). The glow tube (5) is provided with protective coating (6) at least in the area of its tip. The protective coating is selected from the group consisting of materials which include NiCrAlY, CoCrAlY, CoNiCrAlY, NiCrAl, NiCr, NiCrFe and NiCr-WCo.

9 Claims, 1 Drawing Sheet

GLOW PLUG WITH PROTECTIVE COATING

BACKGROUND OF THE INVENTION

1. Field of the Invention

The invention relates to a glow plug with a heating rod formed of an inner pole and a glow tube in which there is a heating element which is electrically joined to the inner pole.

2. Description of Related Art

A glow plug of the initially-mentioned type, which is known, for example, from Published German Patent Application 41 33 338, can be made in the form of a rod glow plug and is used, for example, as a starting aid for an air-compressing internal combustion (i.e., Diesel) engine.

Glow plugs are, moreover, used also for ignition support in heating devices.

The problem with conventionally known glow plugs of this type is that they do not satisfy the future requirements for a short heat-up time, or the shortening of the heat-up time must be bought at the cost of reducing the service life of the glow plug.

SUMMARY OF THE INVENTION

The primary object underlying the present invention is, therefore, to devise a glow plug of the initially-mentioned type which has a short heat-up time and a long service life.

This object is achieved according to the invention by the glow tube, at least in the area in which the heating element is located, is provided with a coating of a material which is selected from among a group of materials which includes NiCrAlY, CoCrAlY, CoNiCrAlY, NiCrAl, NiCr, NiCrFe and NiCrWCo.

The coating provided according to the invention acts as a surface protection for the glow tube, so that its wall thickness can be significantly reduced. The resulting lower mass results in the glow plug according to the invention having a short heat-up time, i.e., rapid heat-up, by which faster starting readiness can be achieved in vehicles with a Diesel engine equipped with these glow plugs. In this case, an extremely fast heat-up time is achieved without adversely affecting the service life of the glow plug.

The embodiment according to the invention, furthermore, has the advantage that the material of the glow plug is prevented from scaling off at the attained short heat-up times, with long afterglow and high temperatures, by which use of glow plugs made from a low cost material becomes possible. Costs are, moreover, saved by the fact that the glow plug can have a lower tube wall thickness.

By means of the coating provided according to the invention, moreover, the size of the glow tube surface is increased by porosity, and thus, heat radiation is improved. The temperature distribution is more uniform and preparation of the impacting fuel particles is improved.

These and further objects, features and advantages of the present invention will become apparent from the following description when taken in connection with the accompanying drawings which, for purposes of illustration only, show a single embodiment in accordance with the present invention.

DETAILED DESCRIPTION OF THE PREFERRED EMBODIMENT

Figure 1:
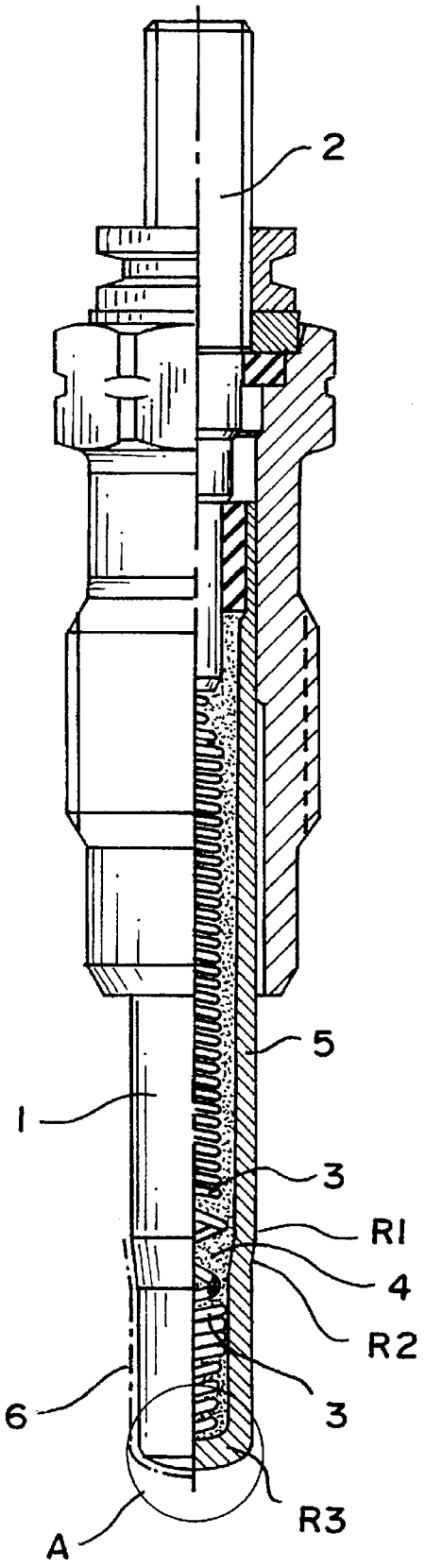
FIG. 1 is a partial cross-sectional view of a glow plug in accordance with a preferred embodiment of the invention.
Figure 1A:
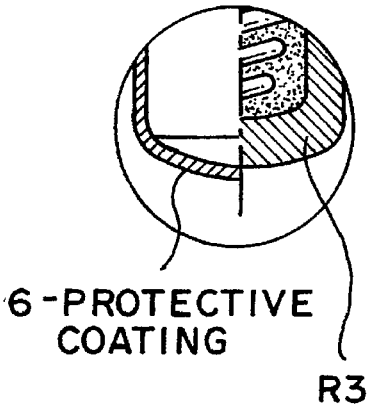
FIG. 1A is an enlarged view of the encircled detail A of FIG. 1.

The embodiment of the glow plug according to the invention which is shown in the drawing comprises a housing in which there is heating rod 1 which comprises an inner pole 2 for connection to the electric power supply and a glow tube 5 in which there is a heating element 3 which is electrically connected to the inner pole 2. Heating element 3 can be formed of a heating coil and a control coil, of which the control coil is joined to the inner pole 2, and heating element 3 is embedded in a filler 4 of MgO within glow tube 5.

Glow tube 5, at least in the area in which the heating element 3 is located, especially at its tip, has a coating 6 of a material which is selected from among a group of materials which includes NiCrAlY, CoCrAlY, CoNiCrAlY, NiCrAl, NiCr, NiCrFe and NiCrWCo. This protective coating can consist, for example, of Ni 22Cr 10Al 1Y. Coating 6 is applied directly to glow plug 5 and has a thickness between 10 and 50 microns, especially between 20 and 30 microns.

In this embodiment, glow tube 5 can be made of conventionally used alloys, for example, Inconel 600 or 601. However, due to the use of the coating 6, which protects the glow tribe 5 against scaling, the glow tube 5 can be provided with a low wall thickness over its entire length or on its tip, or it can be made of another, especially more cost favorable, alloy. With glow plug 5 having a thinner wall, a more rapid heat transfer from heating element 3 to the glow tube surface is achieved.

In order to ensure sufficient adhesion of the coating to the tube over the entire service life of the glow plug, a heating rod or glow tube shape is utilized which has a geometry in which edges, corners and other sharp transitions are rounded off and avoided. In the drawing, R1 designates a site where there is no coating. When the entire tip of the heating rod is coated, between R1 and R2 there is a radius of roughly 1–5 mm. The radius R3 is, conversely, roughly 3 to 5 mm.

Based on the possible lower tube wall thickness of glow plug 5 and the attained uniform heat-up behavior, the power consumption of the glow plug 1 can be significantly reduced; this protects heating element 3. In this case, lower temperatures on the end of the heating rod are possible due to the larger surface which is attained and ceramic plugs are approached.

While a single embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. Glow plug with a heating rod formed of an inner pole, a glow tube, and a heating element, said heating element being electrically connected to the inner pole and being located in said glow tube; wherein the glow tube is provided with a coating of a material which is selected from the group consisting of materials which include NiCrAlY, CoCrAlY, CoNiCrAlY, NiCrAl, NiCr, NiCrFe and NiCrWCo, said coating be provided at least in an area of the glow tube in which the heating element is located.

2. Glow plug according to claim 1, wherein the thickness of the coating is 10 to 50 microns.

3. Glow plug according to claim 2, wherein the thickness of the coating is 20 to 30 microns.

4. Glow plug according to claim 1, wherein the heating element is formed of a heating coil and a control coil, the control coil being joined to the inner pole; and wherein the heating element is embedded in a filler material within the glow tube.

5. Glow plug according to claim 4, wherein the glow tube has a first portion in an area in which the heating coil is located that has a diameter is smaller than that of a second portion of the glow tube in an area in which the control coil is located; and wherein said coating is substantially confined to said first portion of the glow tube and a transition zone of gradually changing diameter in an area between said coils.

6. Glow plug according to claim 5, wherein the coating is formed of Ni 22Cr 10Al 1Y.

7. Glow plug according to claim 1, wherein the coating is formed of Ni 22Cr 10Al 1Y.

8. Glow plug according to claim 7, wherein the thickness of the coating is 10 to 50 microns.

9. Glow plug according to claim 8, wherein the thickness of the coating is 20 to 30 microns.

* * * * *